US006579334B2

(12) United States Patent
Oh et al.

(10) Patent No.: US 6,579,334 B2
(45) Date of Patent: Jun. 17, 2003

(54) CYCLONE DUST COLLECTING APPARATUS FOR VACUUM CLEANER

(75) Inventors: Jang-keun Oh, Kwangju (KR); Jung-seon Park, Kwangju (KR)

(73) Assignee: Samsung Kwangju Electronics Co., Ltd., Kwangju (KR)

( * ) Notice: Subject to any disclaimer, the term of this patent is extended or adjusted under 35 U.S.C. 154(b) by 0 days.

(21) Appl. No.: 09/950,110

(22) Filed: Sep. 10, 2001

(65) Prior Publication Data

US 2002/0124538 A1 Sep. 12, 2002

(30) Foreign Application Priority Data

Mar. 12, 2001 (KR) ..... 2001-12736

(51) Int. Cl.[7] ..... B01D 45/12

(52) U.S. Cl. ..... 55/426; 55/429; 55/459.1; 55/DIG. 3

(58) Field of Search ..... 55/426, 429, 459.1, 55/DIG. 3; 15/350, 353

(56) References Cited

U.S. PATENT DOCUMENTS 6,193,787 B1 * 2/2001 Dyson et al. ..... 55/345
6,231,645 B1 * 5/2001 Conrad et al. ..... 55/426

FOREIGN PATENT DOCUMENTS

WO WO 01/45853 A1 6/2001

* cited by examiner

*Primary Examiner*—Robert A. Hopkins
(74) *Attorney, Agent, or Firm*—Westman, Champlin & Kelly, P.A.

(57) ABSTRACT

A cyclone dust collecting apparatus for a vacuum cleaner is disclosed. The cyclone dust collecting apparatus comprises a cylindrical cyclone body secured to a top of a dust collecting chamber which is provided in a cleaner body and connected to an air drawing path and an air discharging path, the cylindrical cyclone body having an air inlet and an air outlet corresponding to the air drawing path and the air discharging path, respectively, a dirt collecting container removably disposed at a lower portion of the cyclone body for collecting dirt and contaminants centrifuged at the cyclone body, a partition plate disposed between the cyclone body and the dirt collecting container, a first dirt path protruded outwardly from a side of a bottom of the cyclone body for discharging the dust and contaminants centrifuged at the cyclone body into the dirt-collecting container, and a second dirt path protruded outwardly from a side of a top of the dirt collecting container for discharging the dust and contaminants centrifuged at the cyclone body into the dirt collecting container, the first and the second dirt paths corresponding to each other.

8 Claims, 6 Drawing Sheets

CYCLONE DUST COLLECTING APPARATUS FOR VACUUM CLEANER

The present application is based on and claims the benefit of Korean patent application Serial No. 2001-12736, filed Mar. 12, 2001, the content of which is hereby incorporated by reference in its entirety.

BACKGROUND OF THE INVENTION

1. Filed of the Invention

The present invention relates a cyclone dust collecting apparatus, and more particularly, to a cyclone dust collecting apparatus having a dirt collecting container that can be exclusively removed from the cyclone dust collecting apparatus.

2. Description of the Related Art

Generally, an upright type vacuum cleaner having a cyclone dust collecting apparatus comprises a brush connected with a cleaner body and moving along a cleaning surface. The cleaner body is divided into a dust collecting chamber for mounting the cyclone dust collecting apparatus removably, and a motor driving chamber for mounting a motor which provides a suction force. In the above construction, when the motor is driven, it provides the brush with the strong suction force. By the suction force, dust-laden air is drawn from the cleaning surface into the cleaner body. The air then flows into the cyclone dust collecting apparatus mounted on the dust collecting chamber of the cleaner body. The air is drawn into the cyclone dust collecting apparatus, forming a vortex rotating at high speed. Various contaminants entrained in the air are centrifuged by the centrifugal force of the vortex, and are collected at the cyclone dust collecting apparatus, and then cleaned air is externally discharged through the motor driving chamber.

FIG. 1 shows an example of the cyclone dust collecting apparatus. As shown in FIG. 1, the cyclone dust collecting apparatus includes a cyclone body 11 and a cyclone housing 12. The cyclone housing 12 is divided into a centrifuging chamber 12*a* and a dirt collecting chamber 12*b*. An opening 12*c* is formed in a lower side of the centrifuging chamber 12*a*, communicating the centrifuging chamber 12*a* to the dirt collecting chamber 12*b*. The air that flows into the cyclone body 11 forms the vortex in the centrifuging chamber 12*a*. The contaminants entrained in the air are centrifuged by the centrifugal force, and then is discharged together with a certain part of the air to the dirt collecting chamber 12*b* through the opening 12*c*.

The process for emptying out the dust and contaminants from the cyclone dust collecting apparatus, in the case of that the dirt collecting chamber 12*b* is full of the dust and contaminants, will be described. First, the whole cyclone dust collecting apparatus is detached from the dust collecting chamber, and then the cyclone housing 12, at which the dust and contaminants is collected, is detached from the detached cyclone dust collecting apparatus. Then, the dust and contaminants in the dirt collecting chamber 12*b* of the cyclone housing 12 are emptied out.

Since the whole cyclone dust collecting apparatus has to be detached from the dust collecting chamber, and then the cyclone housing 12 has to be detached from the detached dust collecting chamber, in order to empty the dirt collecting chamber 12*b* of the cyclone housing 12, that inconveniences the user.

SUMMARY OF THE INVENTION

The present invention is developed to solve the problems as described above, and accordingly, an object of the present invention is to provide a cyclone dust collecting apparatus of an improved structure from which a dirt collecting container is exclusively detached to empty out the dirt piled therein, without requiring to detach the whole cyclone dust collecting apparatus.

A cyclone dust collecting apparatus for a vacuum cleaner according to the present invention to achieve the object comprises a cylindrical cyclone body secured to a top of a dust collecting chamber which is provided in a cleaner body and connected to an air drawing path and an air discharging path, the cylindrical cyclone body having an air inlet and an air outlet corresponding to the air drawing path and the air discharging path, respectively, a dirt collecting container removably disposed at a lower portion of the cyclone body for collecting dirt and contaminants centrifuged at the cyclone body, a partition plate disposed between the cyclone body and the dirt collecting container, a first dirt path protruded outwardly from a side of a bottom of the cyclone body for discharging the dust and contaminants centrifuged at the cyclone body into the dirt-collecting container, and a second, dirt path protruded outwardly from a side of a top of the dirt collecting container for discharging the dust and contaminants centrifuged at the cyclone body into the dirt collecting container, the first and the second dirt paths corresponding to each other.

Here, the partition plate is connected to an opened bottom of the cyclone body, and has a dirt passage hole disposed at a position corresponding to the first and the second dirt paths.

The first and the second dirt paths protrude outwardly from the cyclone body and the dirt collecting container, respectively, in a tangential direction with respect to outer surface of the cyclone body and the dirt collecting container.

The second dirt path formed on the dirt collecting container has the larger curvature radius than that of the first dirt path formed on the cyclone body.

The cyclone dust collecting apparatus further comprises dirt rotation preventing means for preventing the dust and contaminants flowing into the dirt collecting container from rotating. The dirt rotation preventing means comprises at least one dividing piece protruded from an inner circumference of the dirt collecting container. The dividing piece extends obliquely from the top of the dirt collecting container to the bottom thereof. The cyclone body comprises a centrifuging container having a shape of a cylinder of which both ends are opened, and a head having an air drawing pipe connected to the air drawing path for guiding the air to flow obliquely with respect to the centrifuging container, and an air discharging pipe of which one end is connected to a grill protruded toward the opened bottom of the centrifuging container and the other end is connected to the air discharging path, the head being connected to an opened top of the centrifuging container.

BRIEF DESCRIPTION OF THE DRAWINGS

The object and characteristics of the present invention will be more apparent by describing the preferred embodiment of the present invention with reference to the accompanied reference drawings, in which.

DETAILED DESCRIPTION OF THE PREFERRED EMBODIMENT

Figure 1:
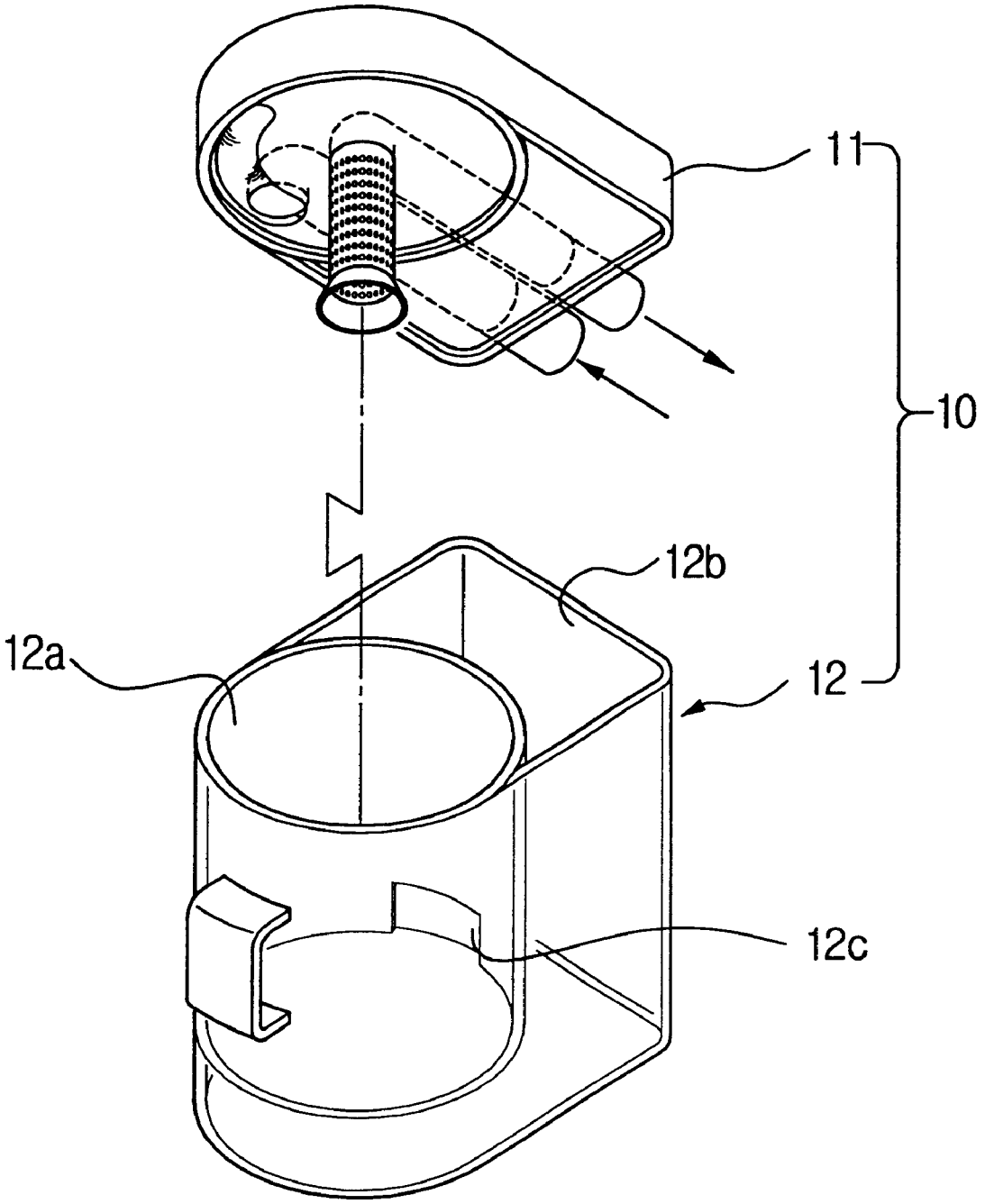
FIG. 1 is a schematic exploded perspective view showing an example of a cyclone dust collecting apparatus.
Figure 2:
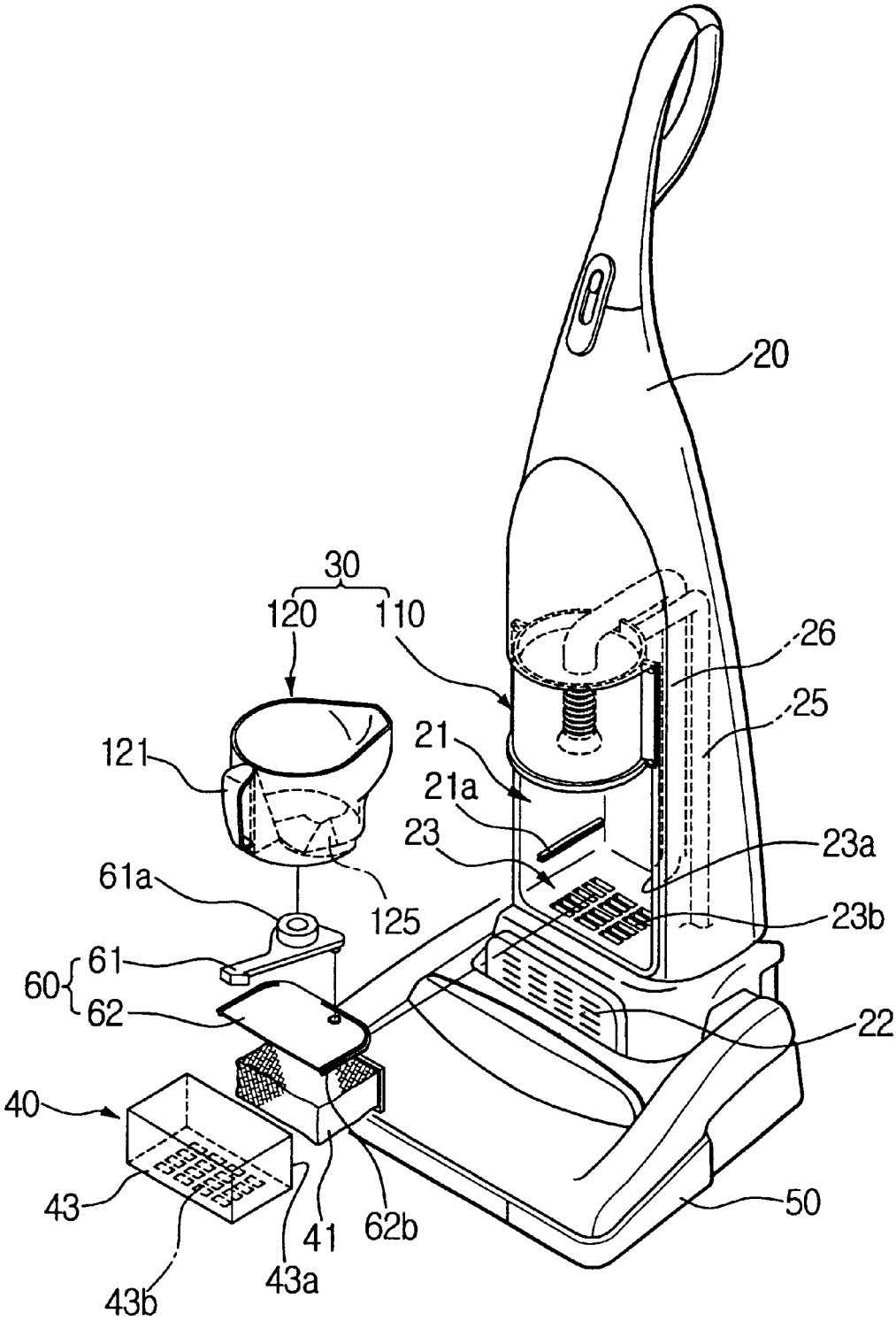
FIG. 2 is a schematic exploded perspective view showing an upright type vacuum cleaner employing the cyclone dust collecting apparatus according to the embodiment of the present invention.

Referring to FIG. 2, an upright type vacuum cleaner comprises a cleaner body 20, a brush 50 disposed at a lower portion of the cleaner body 20, a dust filtering means 40, and a cyclone dust collecting apparatus 30 mounted on a dust collecting chamber 21 of the cleaner body 20.

The cleaner body 20 has the dust collecting chamber 21 for mounting the cyclone dust collecting apparatus 30 therein, a motor driving chamber 22 for mounting a motor (not shown) therein, and a filtering chamber 23 for removably mounting the dust filtering means 40 therein. The dust collecting chamber 21 is connected to an air drawing path 25 and an air discharging path 26. The air drawing path 25 is connected to the brush 50. Thus, the dust and contaminant-laden air that is drawn in at the brush 50 from a cleaning surface flows into the dust collecting chamber 21 through the air drawing path 25. Also, the air discharging path 26 is connected to the motor driving chamber 22, and has the filtering chamber 23 formed thereon and connected to the motor driving chamber 22. Thus, the air discharged from the dust collecting chamber 21 flows through the air discharging path 26, the filtering chamber 23, and the motor driving means 22, and then is discharged out. The filtering chamber 23 has an air inlet 23*a* corresponding to the air-discharging path 26 and an air outlet 23*b* corresponding to the motor driving chamber 22. The air inlet 23*a* is formed in a sidewall of the filtering chamber 23, and the air outlet 23*b* is formed in a bottom of the filtering chamber 23.

The dust filtering means 40 is disposed in the filtering chamber 23. The dust filtering means 40 comprises an air filter 41 and a filter case 43. The air filter 41 is made of a material having a minute air passage hole for filtering remaining dust therethrough, which is not separated at the cyclone dust collecting apparatus 30 disposed in the dust collecting chamber 21. The air filter 41 is generally used in a cleaner, so that the detail descriptions thereof are omitted here. The filter case 43 has an air intake 43*a* connecting to the air drawing path 26, and an air exhaust 43*b* connecting to the motor driving chamber 22. Thus, the air intake 43*a* of the filter case 43 corresponds to the air inlet 23*a* of the filtering chamber 23, and the air exhaust 43*b* corresponds to the air outlet 23*b* of the filtering chamber 23.

The brush 50 is disposed at the lower portion of the cleaner body 20 for moving along the cleaning surface. The dust and contaminants-laden air from the cleaning surface is drawn in at the brush 50 by a suction force generated by the motor driven in the motor driving chamber 22. Preferably, the brush 50 is disposed movably with respect to the cleaner body 20.

The cyclone dust collecting apparatus 30 comprises a cyclone body 110, a dirt collecting container 120, and a partition plate 130.

Figure 3:
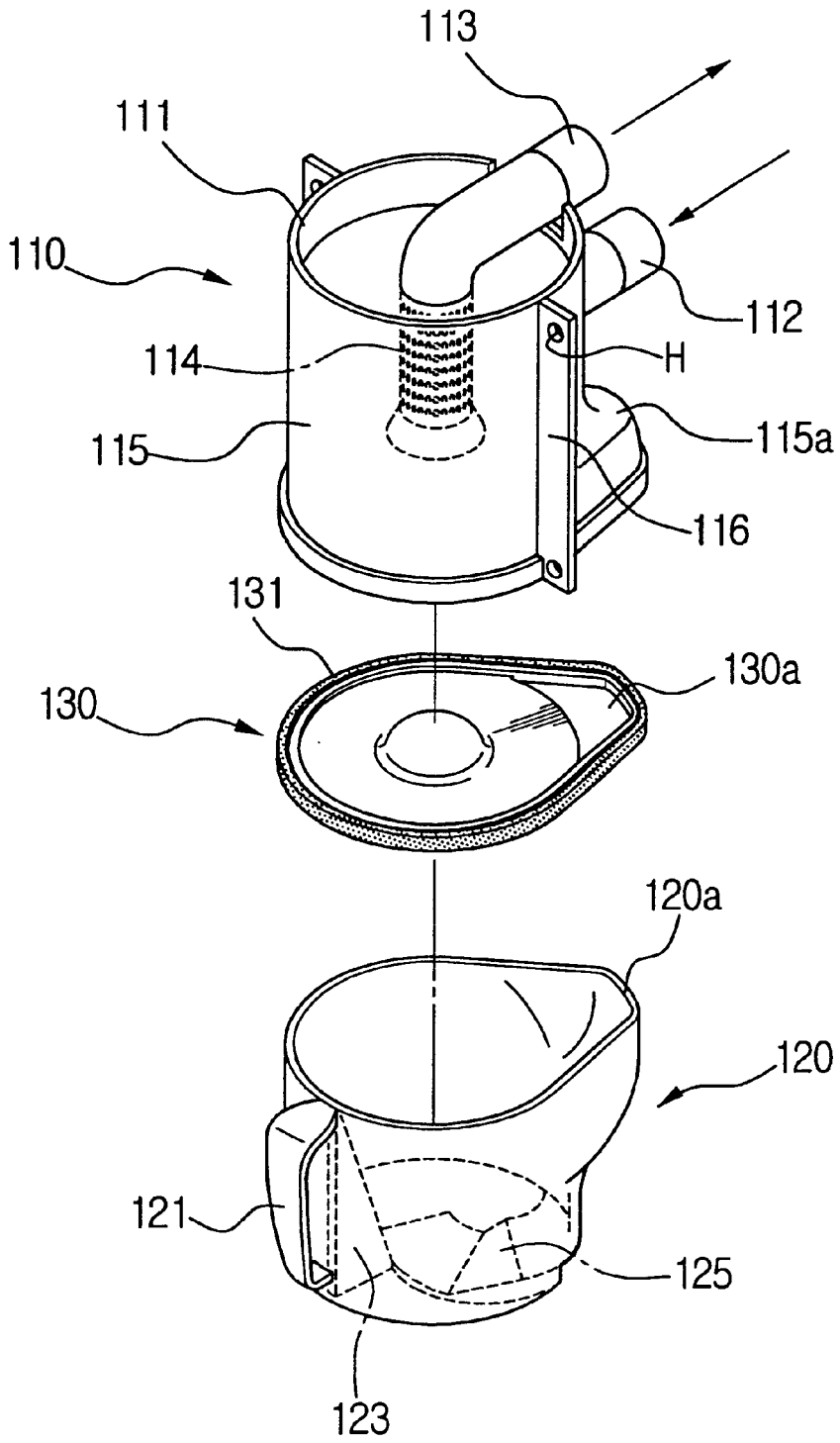
FIG. 3 is an exploded perspective view showing the cyclone dust collecting apparatus of FIG. 2.

The cyclone body 110 is screwed on an upper portion of the dust collecting chamber 21. As shown in FIG. 3, the cyclone body 110 has a head 111 and a cylindrical centrifuging container 115.

The head 111 include an air drawing pipe 112 connected to the air drawing path 25, an air discharging pipe 113 connected to the air-discharging path 26, and a grill 114 for filtering dust therethrough. The head 111 is connected to a top of the centrifuging container 115. The air drawing pipe 112 is formed in a manner that one end thereof is connected to the air drawing path 25 of the cleaner body 20, and the other end thereof is formed to discharge the air obliquely with respect to the centrifuging container 115. One end of the air-discharging pipe 113 is connected to the air-discharging path 26 of the cleaner body 20, and the other end thereof is connected to the grill 114. The grill 114 protrudes toward an opened bottom of the centrifuging container 115, and is in the shape of a cylinder, and has a plurality of minute holes formed on a surface thereof.

The centrifuging container 115 is a cylinder type of which a top and a bottom are opened. There is provided a first dirt path 115*a* protruding outwardly from the bottom of the centrifuging container 115. More specifically, the first dirt path 115*a* protrudes from a side of the bottom of the centrifuging container 115 in a tangential direction with respect to an outer surface of the centrifuging container 115. Accordingly, the lower portion of the centrifuging container 115 has an anti-circular figure. Accordingly, the air flows in, and forms a vortex in the centrifuging container 115 and descends downwardly along an inner circumference of the centrifuging container 115, and then is discharged to the dirt collecting container 120 through the first dirt path 115*a*. Also, a support 116 having a hole H formed therein, is protruded from an outer circumference of the centrifuging container 115 for securing the centrifuging container 115 to the dust collecting chamber 21 by proper securing means such as a screw, or the like.

Figure 4:
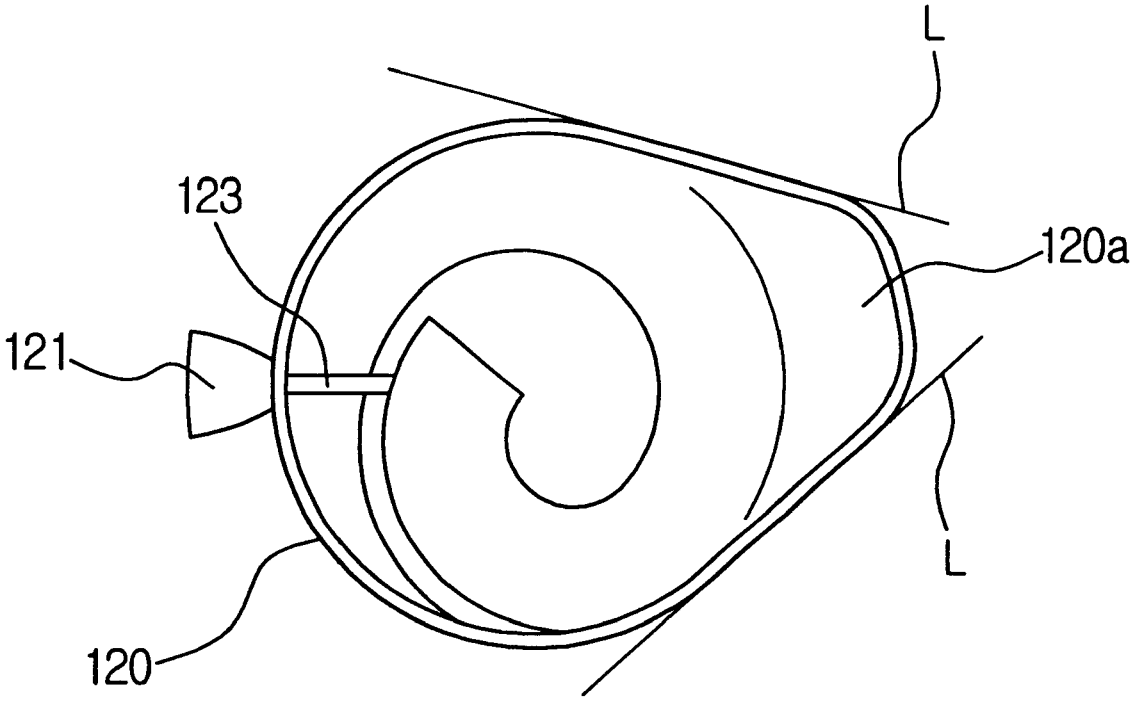
FIG. 4 is a plan view showing a dirt collecting container of FIG. 3.

The dirt collecting container 120 is a cylinder type of which a top is opened and a bottom is closed, and corresponds to the bottom of the centrifuging container 115. A second dirt path 120*a* is formed at the top of the dirt collecting container 120, corresponding to the first dirt path 115*a*. As shown in FIG. 4, the second dirt path 120*a* protrudes from an end of a top of the dirt collecting container 120 outwardly in a tangential direction L with respect to an outer surface of the dirt collecting container 120. The top of the dirt collecting container 120 and the bottom of the centrifuging container 115 is identical to each other in a plat figure so as to be secured to each other closely. A grip 121 is disposed on an outside of the dirt-collecting container. Further, preferably, the dirt collecting container 120 comprises a dirt rotation preventing means formed therein for preventing the dust and contaminants flowing the first dirt and second paths 115*a* and 120*a* from rotating.

The dirt rotation preventing means comprises a dividing piece 123 extended along the inner circumference of the dirt-collecting container 120 from the top of the dirt collecting container 120 to the bottom thereof obliquely. The dividing piece 123 prevents the dirt collected at the dirt collecting container 120 from rotating, thereby preventing a back flow of the dirt to the first and second dirt paths 115*a* and 120*a*.

The partition plate 130 is disposed between the centrifuging container 115 and the dirt collecting container 120. Preferably, the partition plate 130 is press-fitted to the top of the dirt collecting container 120. For this, the partition plate 130 has a plate figure corresponding to the bottom of the centrifuging container 115 and the top of the dirt collecting container 120, and a dirt passage hole 130*a* formed on a side corresponding to the first and the second dirt paths 115*a* and 120*a*. Thus, the partition plate 130 not only prevents the centrifuging container 115 and the dirt collecting container 120 from communicating to each other directly in a vertical direction, but also communicates the first dirt path 115*a* to the second dirt path 120*a*, thereby collecting the centrifuged dirt and contaminants in the dirt collecting container 120 effectively. Preferably, a sealing element is disposed on an edge of the partition plate 130 for sealing the bottom of the centrifuging container 115 securely.

Figure 6:
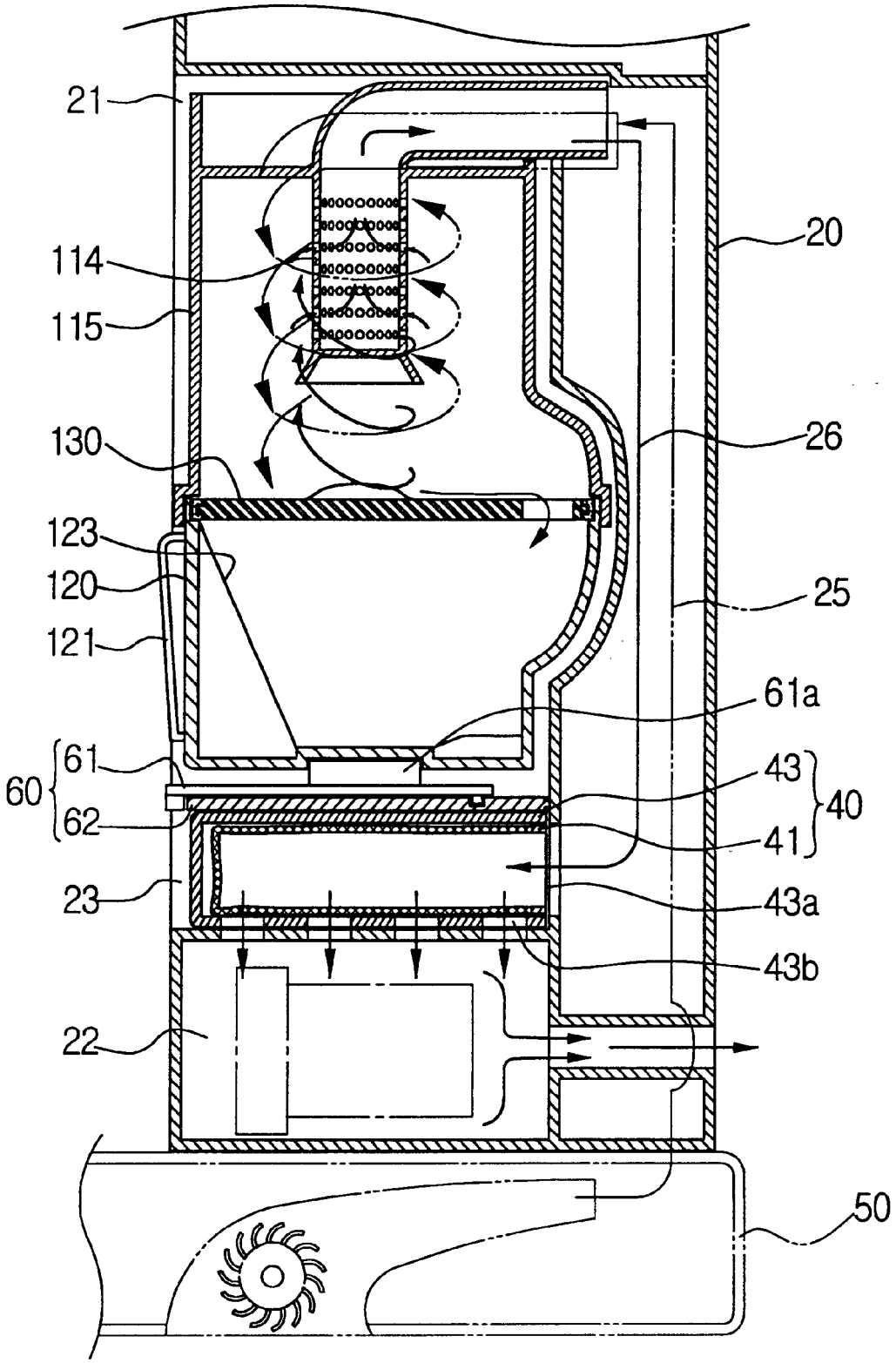
FIG. 6 is a section view showing the upright type vacuum cleaner of FIG. 2 being assembled.

As shown in FIG. 6, the fist and the second dirt paths 115*a* and 120*a* are respectively formed in the shape of a semicircular arc having a predetermined curvature radius. The second dirt path 120*a* of the dirt collecting container 120 has preferably a larger curvature radius than that of the first dirt path 115*a* of the centrifuging container 115. Accordingly, the dirt flowing into the first dirt path 115*a* of the centrifuging container 115*a* flows fast into the second dirt path 120*a*, of which the curvature radius gets larger as it slops downwardly, and then is rapidly collected at the dirt collecting container 120. The first and the second dirt paths 115*a* and 120*a* for discharging the dirt centrifuged in the centrifuging container 115 to the dirt collecting container 120 are formed integrally with the centrifuging container 115 and the dirt collecting container 120, respectively, by transforming each end of the centrifuging container 115 and the dirt collecting container. Therefore, there is no need for an extra process in manufacturing of the centrifuging container 115 and the dirt collecting container 120. Also, the first and the second dirt paths 115*a* and 120*a* are lopsidedly formed so that discharge of the dirt can be performed satisfactorily and also the back flow of the dirt can be prevented effectively.

Meanwhile, there is further provided a connecting/disconnecting means 60 for mounting and removing the dirt collecting container 120 to/from the bottom of the centrifuging container 115 in the dirt collecting chamber 21 more easily.

Figure 5:
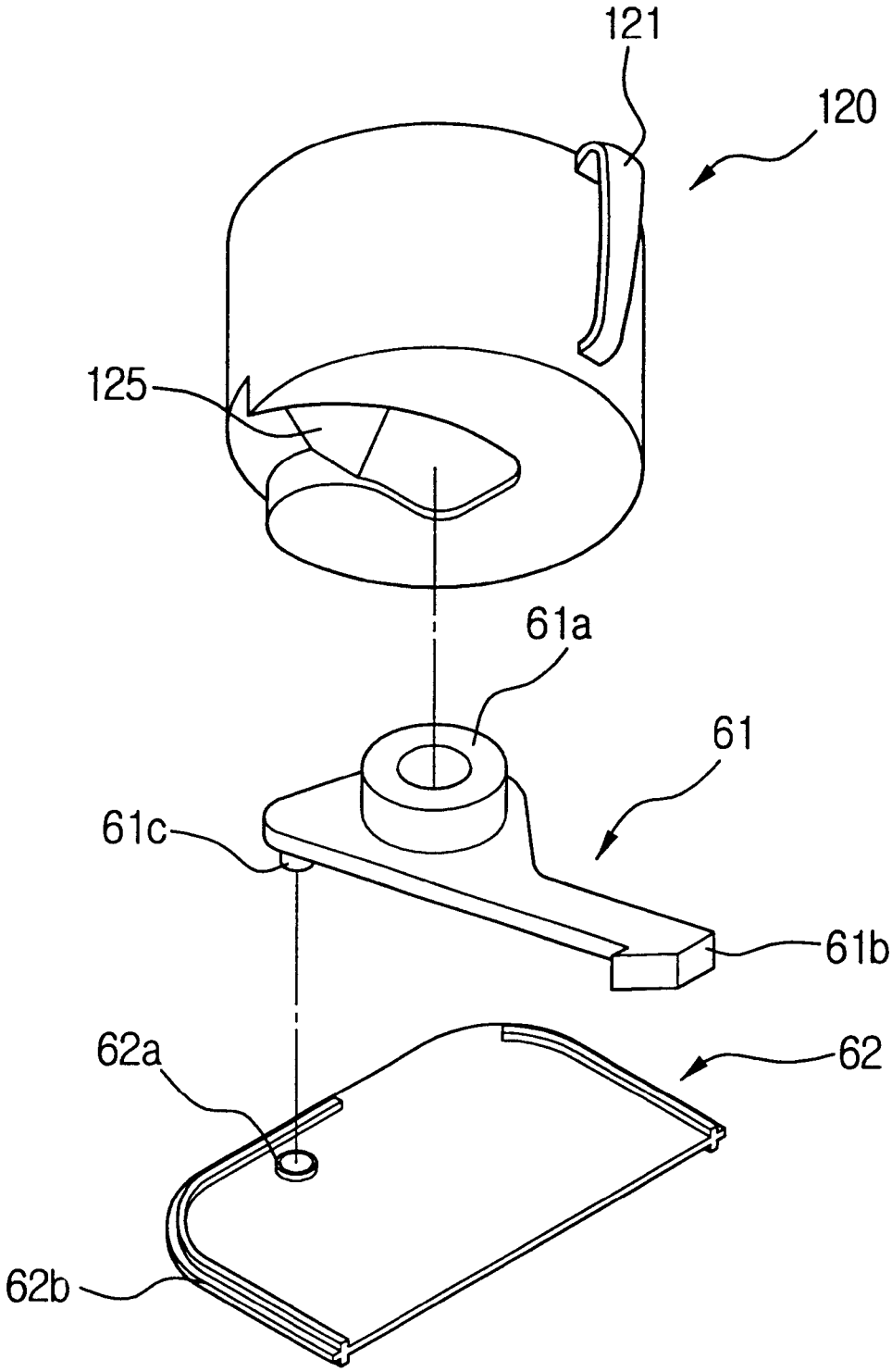
FIG. 5 is an exploded perspective view showing attaching/detaching means of FIG. 2.

As shown in FIG. 5, the connecting/disconnecting means 60 comprises an inclined recess 125 formed at the bottom of the dirt-collecting container 120, a securing element 61 having a protrusion 61*a* formed thereon to correspond to the inclined recess 125, and a base 62 for supporting the dust collecting apparatus 30 and a relative movement of the securing element 61 with respect to the inclined recess 125, simultaneously.

The inclined recess 125 is formed in the shape of spiral, and the depth thereof gets deeper from center toward the outer circumference of the dirt collecting container 120.

The securing element 61 comprises a pivot pin 61*c* formed on one end thereof as a pivot, a lever 61*b* formed on the other end thereof for allowing a user to turn it, and the protrusion 61*a* formed between both ends of the securing element 61 and corresponding to the inclined recess 125.

The base 62 comprises a connecting protrusion 62*b* corresponding to a guide recess 21*a* formed on an inner wall of the dust collecting chamber 21, and is thus mounted in the dust-collecting chamber 21 removably. The base 62 also comprises a hole 62*a* corresponding to the pivot pin 61*c* of the securing element 61.

In the connecting/disconnecting means 60 as constructed above, if the user turns the lever 61*b* of the securing element 61 in one direction (in a clockwise direction in FIG. 5), the protrusion 61*a* moves along the inclined recess 38.

The operation of the upright type vacuum cleaner employing the cyclone dust collecting apparatus thereon according to the embodiment of the present invention as constructed above is described as follows.

If the motor of the motor driving chamber 22 is driven, the suction force generates at the brush 50. By the suction force, the dust and contaminants-laden air from the cleaning surface is drawn into the cyclone body 110 through the brush 50 and air drawing path 25. At this time, the air flows obliquely along the inner circumference of the centrifuging container 115 due to the air drawing pipe 112 of the head 111 into the vortex current. The relatively larger dust or contaminants entrained in the air is centrifuged by the centrifugal force of the vortex, and discharged into the dirt collecting container 120 through the first and the second dirt paths 115*a* and 120*a*. The discharged dust and contaminants are collected at the bottom of the dirt collecting container 120. At this time, the collected dirt and contaminants does not flow back into the centrifuging container 115 since the centrifuging container 115 is closed by the partition plate 130. Further, flow or rotation of the dust and contaminants collected at the dirt collecting container 120 is restricted due to the presence of the dividing piece 123. Accordingly, the back flow through the first and the second dirt paths 115*a* and 120*a* is prevented.

Meanwhile, air cleaned in the cyclone body 31 is discharged to the air-discharging pipe 113 through the minute passage hole of the grill 114 of the head 111. The cleaned air flows from the air discharging pipe 113 into the filter case 43 of the filtering chamber 23 through the air-discharging path 26. Relatively minute dust as the air flows the filter case 43, which is not separated at the cyclone dust collecting apparatus 30, is filtered through the air filter 41. While the remaining cleaned air flows into the motor driving chamber 22 and is discharged out.

Meanwhile, since a method for mounting and removing the dirt collecting container 120 on/from the dust-collecting chamber 21 is disclosed in detail in the Korea Patent No. 10-2001-0001617 filed by the applicant of the present invention, the description thereof is omitted here.

In the upright type vacuum cleaner according to the present invention, the whole cyclone dust collecting apparatus 30 is not required to be removed from the dust collecting chamber 21 to empty out the collected dust and contaminants, but the dirt collecting container 120, which holds the dust and contaminants therein, can be exclusively removed from the vacuum cleaner. Accordingly, it is convenient for a user to empty the collected dust and contaminants from the dust collecting apparatus.

Further, since the first dirt path 115*a* and the second dirt path 120*a* are formed integrally with the centrifuging container 115 and the dirt-collecting container 120, respectively, by transforming the each end of the centrifuging container 115 and the dirt collecting container to correspond to each other, the structure is simplified, and efficiency of discharging the dirt and the back flow prevention is enhanced.

While the upright type vacuum cleaner employing the cyclone dust collecting apparatus according to the embodiment of the present invention is described above, such description is for illustrative purpose only, it is to be understood that the cyclone dust collecting apparatus according to the present invention is employed in a canister type and a portable vacuum cleaner and the like, alternatively.

What is claimed is:

1. A cyclone dust collecting apparatus for a vacuum cleaner comprising:

a cylindrical cyclone body secured to a top of a dust collecting chamber which is provided in a cleaner body and connected to an air drawing path and an air discharging path, the cylindrical cyclone body having an air inlet and an air outlet corresponding to the air drawing path and the air discharging path, respectively;

a dirt collecting container removably disposed at a lower portion of the cyclone body for collecting dirt and contaminants centrifuged at the cyclone body;

a partition plate having an opening disposed between the cyclone body and the dirt collecting container;

a first dirt path protruded outwardly from a side of a bottom of the cyclone body for discharging the dust and contaminants centrifuged at the cyclone body into the dirt-collecting container; and a second dirt path protruded outwardly from a side of a top of the dirt collecting container for discharging the dust and contaminants centrifuged at the cyclone body into the dirt collecting container, the first and the second dirt paths coupled to each other through the opening in the partition plate.

2. The cyclone dust collecting apparatus of claim 1, wherein the partition plate is connected to an opened bottom of the cyclone body, and has a dirt passage hole disposed at a position corresponding to the first and the second dirt paths.

3. The cyclone dust collecting apparatus of claim 1, wherein the first and the second dirt paths protrude outwardly from the cyclone body and the dirt collecting container, respectively, in a tangential direction with respect to outer surfaces of the cyclone body and the dirt collecting container.

4. The cyclone dust collecting apparatus of claim 1, wherein the second dirt path formed on the dirt collecting container has the larger curvature radius than that of the first dirt path formed on the cyclone body.

5. The cyclone dust collecting apparatus of claim 1, further comprising dirt rotation preventing means for preventing the dust and contaminants flowing into the dirt collecting container from rotating.

6. The cyclone dust collecting apparatus of claim 5, wherein the dirt rotation preventing means comprises at least one dividing piece protruded from an inner circumference of the dirt collecting container.

7. The cyclone dust collecting apparatus of claim 6, wherein the dividing piece extends obliquely from the top of the dirt collecting container to the bottom thereof.

8. The cyclone dust collecting apparatus of claim 1, wherein the cyclone body comprises:

a centrifuging container having a shape of a cylinder, of which both ends are opened; and a head having an air drawing pipe connected to the air drawing path for guiding the air to flow obliquely with respect to the centrifuging container, and an air discharging pipe of which one end is connected to a grill protruded toward the opened bottom of the centrifuging container and the other end is connected to the air discharging path, the head being connected to an opened top of the centrifuging container.

* * * * *